US008215874B2

(12) United States Patent
Reeves

(10) Patent No.: US 8,215,874 B2
(45) Date of Patent: Jul. 10, 2012

(54) MODULAR FOUNDATION DESIGNS AND METHODS

(76) Inventor: William W. Reeves, Salt Lake City, UT (US)

( * ) Notice: Subject to any disclaimer, the term of this patent is extended or adjusted under 35 U.S.C. 154(b) by 210 days.

(21) Appl. No.: 12/686,374

(22) Filed: Jan. 12, 2010

(65) Prior Publication Data

US 2010/0178114 A1 Jul. 15, 2010

Related U.S. Application Data

(60) Provisional application No. 61/143,963, filed on Jan. 12, 2009, provisional application No. 61/294,406, filed on Jan. 12, 2010.

(51) Int. Cl.
*E02D 13/04* (2006.01)

(52) U.S. Cl. ..... 405/255; 405/229; 405/232; 405/227; 52/169.9

(58) Field of Classification Search ..... 405/204, 405/206, 208, 224, 227, 228, 229, 231, 232, 405/255; 52/169.9

See application file for complete search history.

(56) References Cited

U.S. PATENT DOCUMENTS

| | | | | | |
|---|---|---|---|---|---|
| 3,825,076 | A * | 7/1974 | Kolb | 405/228 |
| 3,878,662 | A * | 4/1975 | Cernosek | 52/169.9 |
| 4,084,385 | A * | 4/1978 | Boyadjieff | 405/228 |
| 4,257,488 | A * | 3/1981 | Schnell | 405/232 |
| 4,367,056 | A * | 1/1983 | Seneviratne | 405/228 |
| 4,687,062 | A * | 8/1987 | Beghetto et al. | 405/227 |
| 4,784,527 | A * | 11/1988 | Hunter et al. | 405/227 |
| 4,822,212 | A * | 4/1989 | Hall et al. | 405/227 |
| 4,966,496 | A * | 10/1990 | Stelzer, Jr. | 405/227 |
| 5,012,875 | A * | 5/1991 | Casbarian et al. | 405/227 |
| 5,244,312 | A * | 9/1993 | Wybro et al. | 405/229 |
| 5,431,512 | A * | 7/1995 | Haney | 405/224 |
| 6,036,404 | A * | 3/2000 | De Medeiros et al. | 405/224 |
| 2002/0031404 | A1 * | 3/2002 | Junio et al. | 405/223.1 |
| 2010/0031589 | A1 * | 2/2010 | Fernald et al. | 52/169.9 |
| 2011/0037264 | A1 * | 2/2011 | Roddier et al. | 405/224 |
| 2011/0135400 | A1 * | 6/2011 | Hall | 405/228 |

* cited by examiner

*Primary Examiner* — Frederic L Lagman
(74) *Attorney, Agent, or Firm* — Workman Nydegger

(57) ABSTRACT

Designs and methods for a modular foundation provide a strong and secure foundation in a time efficient and cost efficient manner. The modular foundation can include a cap structure having one or more pile guides coupled together. The modular foundation can further include piles that extend through the pile guides and into the ground. The cap structure and pile guides can be configured to use both vertical and angled piles. A plurality of connectors can connect the cap structure to the piles. The resulting foundation can be used to support various superstructures.

24 Claims, 8 Drawing Sheets

MODULAR FOUNDATION DESIGNS AND METHODS

CROSS-REFERENCE TO RELATED APPLICATIONS

This patent application claims the benefit of and priority to U.S. Provisional Patent Application Ser. No. 61/143,963, entitled "MODULAR BRIDGE DESIGN AND METHODS," filed Jan. 12, 2009, the disclosure of which is incorporated herein by reference in its entirety.

Also, this patent application claims the benefit of and priority to U.S. Provisional Patent Application Ser. No. 61/294,406, entitled "MODULAR FOUNDATION DESIGNS AND METHODS," filed Jan. 12, 2010, the disclosure of which is incorporated herein by reference in its entirety

BACKGROUND OF THE INVENTION

1. The Field of the Invention

The present invention relates to designs and methods of modular foundation construction for bridges, piers, homes, or other structures that may incorporate a foundation. In particular, the present invention provides designs and methods of modular foundation construction such that an engineer may fabricate a portion of the foundation offsite, transport the fabricated portions to the construction site, and assemble the fabricated portions to construct the foundation for the desired structure.

2. The Relevant Technology

Many engineers today use some form of modular construction. In modular construction, an engineer may fabricate some portion of the structure offsite and then transport the fabricated portions to the construction site to be assembled. For example, in bridge construction, an engineer may fabricate the superstructure span portions offsite (such as prestressed concrete girders or pre-fabricated steel girders), and then assemble the fabricated portions at the construction site in order to speed construction and lower costs. Similarly, in building or home construction, an engineer may fabricate beams or columns offsite and subsequently erect the beams or columns onsite in the construction process of the building or home. In most cases, the construction industry recognizes the time and money saving benefits of minimizing the construction onsite by using modular techniques.

In contrast to the above discussion, the foundation is one portion of a typical structure that remains predominantly constructed onsite. Due to the difficulties in using modular techniques in the foundation construction process, modular construction progress in the overall construction of structures has been hampered. Given that typical foundation construction is not modular, the benefit gained from using other modular techniques to construct the remaining structure is diminished.

In particular, an engineer may spend weeks or even months constructing a typical cast-in-place foundation onsite. For example, a typical cast-in-place foundation may include a plurality of piles that an engineer drives into ground. The engineer may then construct a massive cast-in-place concrete cap to join the piles together, and to create an interface to join the foundation to the supported structure. Due to the time, effort, and materials an engineer may use to construct the cap, the construction of the entire structure may be slower, as well as more expensive.

Typical foundation designs and construction methods provide several challenges that tend to impede the modularization of foundation construction. One such challenge, for example, is the large size and heavy weight of the various foundation portions. In particular, the foundation cap may be a large and heavy, thus making it difficult to transport, and even more difficult to properly place during an assembly process. Thus, given the size and weight of typical foundation portions, a modular foundation construction may not be possible.

In addition to size and weight constraints, the tolerances between the various foundation portions may impede a modular foundation construction process. For example, and as discussed above, typical foundations include piles that an engineer may drive into the ground. During the pile driving process, the pile may move laterally with respect to an intended final position. In particular, during the pile driving process, a pile may "walk" because of soil irregularities or other uncontrollable factors. These deviations in tolerances with the final location of piles make it difficult for an engineer to anticipate the final dimensions, and thus impede an engineer's ability to prefabricate other portions of the foundation.

Mover, typical foundation components may not provide an efficient load path. For example, cast-in-place caps may result in a load path from the columns, through the cap, and subsequently into the plurality of piles. Engineers, however, may be impeded from constructing a foundation with a more efficient load path due to the limitations as discussed above. In particular, because a cast-in-place cap is designed to join the plurality of piles, it inherently also covers the piles causing the load path to be distributed through the cast-in-place cap, before being distributed to the piles.

BRIEF SUMMARY OF THE INVENTION

Implementations of the present invention comprise systems, methods, and apparatuses that allow an engineer to prefabricate a majority of the components to construct a modular foundation that subsequently can be used to support a wide variety of structures. As a result, the system and methods of the present invention can significantly decrease the amount of onsite construction time needed to complete the foundation, thereby reducing the time costs associated with the foundation construction process. The system may also use a significantly lesser amount of materials, thereby also reducing the material costs of the foundation construction process. In addition, the system may reduce the environmental impact typically associated with the foundation construction process. Accordingly, the system and methods of the present invention can provide a constructed foundation much more quickly and less expensively than typical foundation construction methods and systems.

Implementations of the present disclosure include a modular foundation configured to support one or more components of a superstructure. In one implementation, the modular foundation can include a cap structure including one or more pile guides. In addition, the modular foundation can include one or more piles configured to pass through the one or more pile guides of the cap structure and configured to be driven into a soil or other material. The modular foundation may also include one or more connectors configured to connect the cap structure to the one or more piles.

Further implementations of the present disclosure include a method of constructing a modular foundation. In one implementation, the method can include positioning a cap structure where a foundation is desired. In particular, the cap structure can include a plurality of pile guides. In addition, the method can include driving one or more piles at least partially through the pile guides of the cap structure. For example, the piles can be driven through the pile guides and into a material below the cap structure. The method may also include connecting the cap structure to the one or more driven piles using one or more connectors.

In addition, the present disclosure includes implementations of a modular foundation system. In one implementation, the modular foundation system of the present disclosure can include a modular foundation. In particular, the modular foundation can include a cap structure including one or more pile guides. In addition, the modular foundation can include one or more piles configured to pass through the one or more pile guides of the cap structure. The modular foundation may also include one or more connectors configured to connect the cap structure to the one or more piles. In a further implementation, the modular foundation system of the present disclosure may include a superstructure configured to be supported by the modular foundation.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Implementations of the present invention comprise systems, methods, and apparatuses that allow an engineer to prefabricate a majority of the components to construct a modular foundation that subsequently can be used to support a wide variety of structures. As a result, the system and methods of the present invention can significantly decrease the amount of onsite construction time needed to complete the foundation, thereby reducing the time costs associated with the foundation construction process. The system may also use a significantly lesser amount of materials, thereby also reducing the material costs of the foundation construction process. In addition, the system may reduce the environmental impact typically associated with the foundation construction process. Accordingly, the system and methods of the present invention can provide a constructed foundation much more quickly and less expensively than typical foundation construction methods and systems.

Figure 1:
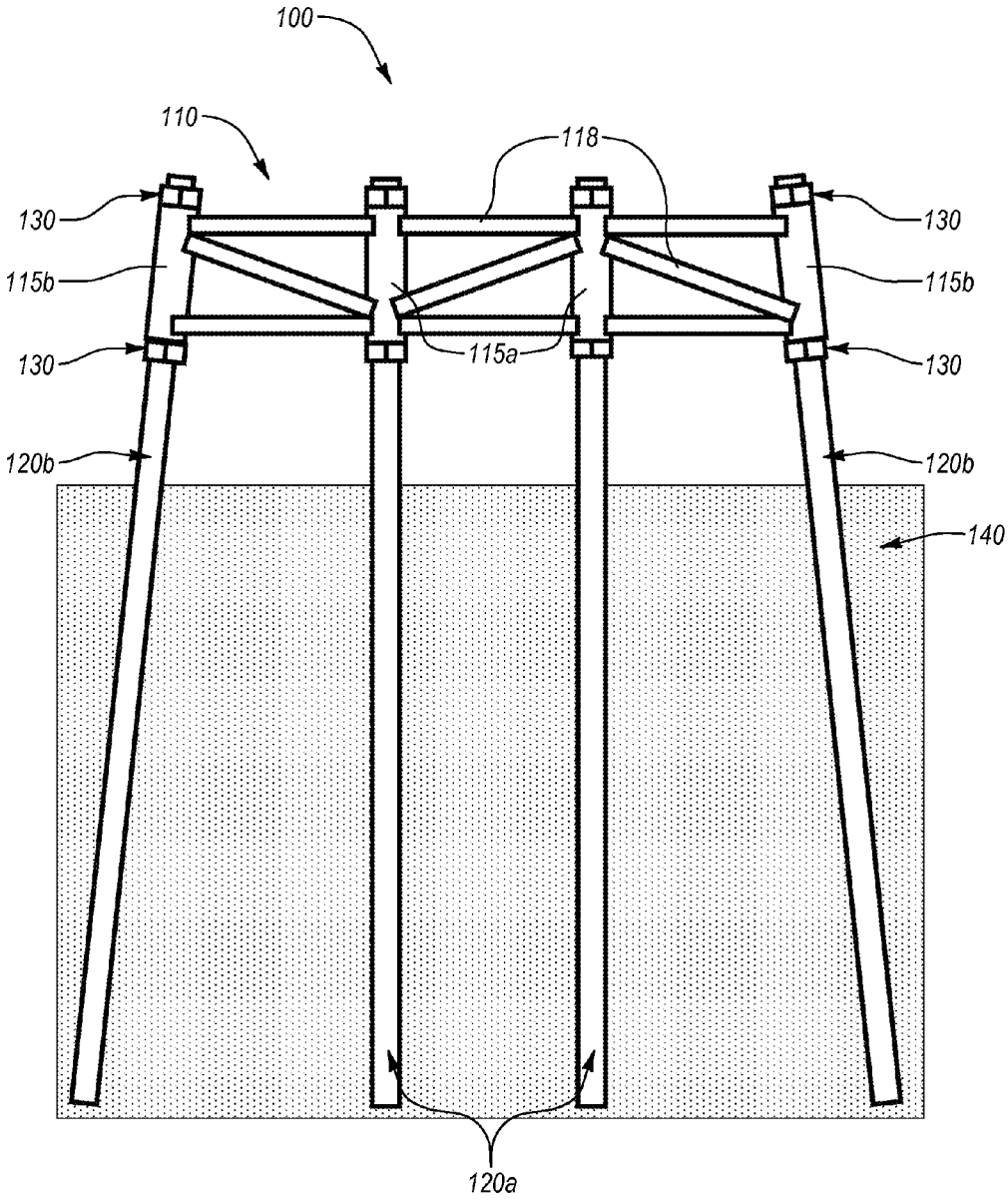
FIG. 1 illustrates an example modular foundation in accordance with an implementation of the present invention.

As an overview, FIG. 1 illustrates an example implementation of a modular foundation 100 according to one or more implementations of the present invention. The modular foundation 100 can include a cap structure 110 that can be connected to piles 120 by way of connectors 130. The various components of the modular foundation 100 allow for onsite assembly of the modular foundation 100. In particular, the cap structure 110 can be prefabricated, transported to the site, and assembled with the other components to form the modular foundation 100. The piles 120, cap structure 110, and the connectors 130 can each vary from one implementation to the next to create various implementations of the modular foundation 100, as will be discussed with more detail below.

An engineer can use the modular foundation 100 for a variety of structures. For example, an engineer can use the modular foundation 100 to build a foundation for bridges, pedestrian walkways, port structures, piers, decks, residential building, commercial buildings, utility structures, windmills, or any other structure that can benefit from a foundation-like structure.

An engineer may also use the modular foundation 100 in a variety of geographic terrains. For example, the modular foundation 100 can be used to support a structure above soil 140, as illustrated in FIG. 1. Soil can include any layer of rock, soil, or earth. In other implementations, an engineer can use the modular foundation 100 to support a structure over water. In a water terrain, the piles 120 can be driven into the soil 140 below the water and extend above the water level such that the cap structure 110 is positioned above the waterline. In alternative implementations, the cap structure 110 may be partially or fully submerged below the waterline, depending on the desired distance between the water and the supported structure. An engineer can use the modular foundation 100 to support a structure above almost any geographic terrain. In addition, the modular foundation 100 enables an engineer to construct a supported structure with little to no impact on the existing terrain. In particular, typical excavation of onsite materials can be avoided (with the exception of driving piles into the ground).

Just as an engineer can use the modular foundation 100 in a variety of geographic terrains, an engineer can use various numbers of modular foundations 100 to support a structure. For example, an engineer can employ a plurality of modular foundations along a length of the structure to support the structure. The number and spacing of modular foundations can vary as desired according to different implementations. In addition, the height of each modular foundation 100 can also vary as desired for a particular application.

As referred to above, the modular foundation 100 can vary from one implementation to the next. One way in which the modular foundation 100 can vary is with the number of piles 120 associated with the modular foundation 100. For example, and as illustrated in FIG. 1, there can be four piles 120 associated with the modular foundation 100. In alternative implementations, an engineer can associate more or fewer piles with the modular foundation 100.

As with the number of piles 120 associated with the modular foundation 100, the geometric configuration of the piles 120 can vary from one implementation to the next. For example, FIG. 1 illustrates example piles 120 that have a substantially cylindrical geometric configuration. In alternative implementations, the piles 120 can have various other geometric configurations, including, but not limited to, rectangular, triangular, H-shaped, I-shaped or any other geometric configuration. In addition to the geometric configuration, the piles 120 can be either tubular or non-tubular. In particular, piles 120 can have a cylindrical tubular configuration that includes a hollowed center and a wall thickness, for example. In another example implementation, the pile 120 may be non-tubular (e.g., solid).

In addition to the geometric configuration of the piles 120, the dimensions of the piles 120 can also vary. For example, the height, cross-sectional dimension, and other dimensions of the piles 120 can vary depending on the specific modular foundation 100 application and/or soil 140 properties in which the piles 120 are located. For example, a modular foundation 100 application requiring large resistive forces (e.g., a large highway bridge) can have larger piles 120 compared to a modular foundation 100 application requiring smaller resistive forces (e.g., a pedestrian walkway). Moreover, the size of the piles 120 may vary within a single implementation of the modular foundation 100. For example, vertical piles 220*a* may be a different size that angled piles 220*b*.

Just as the size of the piles 120 can vary, so too can the material of the piles 120 vary from one implementation to the next, and within a single implementation. Example pile 120 materials include, but are not limited to, precast/pre-stressed concrete, concrete, steel, timber, composites, or combinations thereof. Other pile materials can also be used depending on the specific application of the modular foundation 100.

The orientation of the piles 120 can also vary from one implementation to the next. For example, FIG. 1 illustrates a modular foundation 100 that includes two vertical piles 120*a* and two angled piles 120*b*. An engineer can orient the vertical piles 120*a* to be substantially parallel to gravity, while with the same modular foundation 100, an engineer can also orient angled piles 120*b* to be angled between about three degrees to about forty-five degrees with respect to gravity. In other implementations, an engineer can orient the piles 120 to almost any degree and in almost any orientation, including orientations where the piles 120*b* are angled with respect to different vertical planes.

Notwithstanding the configuration, material, or orientation of the piles 120, an engineer can associate the piles 120 with the cap structure 110, as illustrated in FIG. 1. In particular, the cap structure 110 can include pile guides 115 through which the piles 120 can extend. In particular, pile guides 115 can have a tubular configuration with an inside cross-sectional dimension that is greater than or equal to the outside cross-sectional dimension of the corresponding pile 120 such that the piles 120 can extend through the pile guides 115.

In one implementation, for example, and as illustrated in FIG. 1, the cap structure 110 can include four pile guides 115 that are respectively associated with the four piles 120. In other implementations, the cap structure 110 can include more or fewer pile guides 115, depending on the number of piles used to create the modular foundation 100. Moreover, and as with the piles 120, the pile guide 115 geometric configuration, size, and orientation can vary from one implementation to the next, depending on the configuration, size, and orientation of the piles 120, as discussed above. For example, FIG. 1 illustrates an example cap structure 110 that includes two vertical pile guides 115*a* and two angled pile guides 115*b* that correspond to the two vertical piles 120*a* and the two angled piles 120, respectively. In alternative implementations, the pile guides 115 can have various other orientations, depending on the specific application.

An engineer can design the pile guides 115 to be positioned with respect to one another in various configurations. For example, FIG. 1 illustrates one example implementation wherein the piles guides 115 are configured in a substantially linear configuration. In alternative embodiments, for example, the pile guides 115 can be positioned in a substantially rectangular, triangular, or other configuration with respect to one another, depending on the desired footprint for the modular foundation 100.

As with the other portions of the modular foundation 100, an engineer can make the pile guides 115 from a variety of materials. For example, the pile guides 115 can be made from reinforced concrete, steel, timber or similar materials. Moreover, the pile guides 115 can be made from hybrid materials using combinations of materials. Furthermore, the pile guides 115 can be constructed with high tech materials such as carbon composites, plastics, or recycled materials.

As shown in FIG. 1, the cap structure 110 can include one or more pile guide connectors 118 that assist to secure, brace, and position the pile guides 115 with respect to one another. For example, and as illustrated in FIG. 1, the pile guide connectors 118 can be braces that are connected between two pile guides 115. The braces create a cap structure 110 frame that can resist lateral forces efficiently. In other example embodiments, the pile guide connectors 118 can be a solid piece of concrete that secures, braces, and positions the pile guides 115 in a particular position.

In one example implementations where the pile guide connectors 118 are braces, as illustrated in FIG. 1, the cap structure 110 can include three pile guide connectors 118 that connect adjacent pile guides 115. In alternative implementations, the cap structure 110 can include more or fewer pile guide connectors 118. Moreover, the orientation of the pile guide connectors 118 with respect to one another can vary. As FIG. 1 illustrates, the pile guide connectors 118 can have a substantially horizontal configuration, such as the top and bottom pile guide connectors 118. Alternatively, the pile guide connectors 118 can be angled, as shown by the middle pile guide connectors 118 shown in FIG. 1.

As with the pile guides 115, an engineer can make the pile guide connectors 118 from a variety of materials. For example, the pile guide connectors 118 can be made from reinforced concrete, steel, timber, or other similar materials. Moreover, the pile guide connectors 118 can be made from hybrid materials using combinations of materials. Furthermore, the pile guide connectors 118 can be constructed with high tech materials such as carbon composites, plastics, or recycled materials.

As illustrated in FIG. 1, the piles 120 can be connected and secured to the pile guides 115, and subsequently to the cap structure 110, by way of connectors 130. The connectors 130 can facilitate fastening the cap structure 110 to the piles 120, such as by welding, bolting, and/or or similar fastening methods, which will be discussed in more detail below. The connectors 130 can also seal openings at the top and bottom of the pile guides 115 to prevent moisture or other materials from entering into the pile guides 115 and damaging or corroding the cap structure 110 or piles 120.

In one example implementation, and as illustrated in FIG. 1, an engineer can design the modular foundation 100 to include connectors 130 that are located on both the top of the pile guide 115, and the bottom of the pile guide 115. In this way, the piles 120 are secured to the cap structure 110 to produce a solid modular foundation 100. The number of connectors 130 can vary from one implementation to the next. For example, in alternative implementations, each pile 120 can be connected to a pile guide 115 using only a single connector 130. The single connector 130 can be located on the top or bottom of the pile guide 115, or at any location in-between. Similarly, a pile 120 can be connected to the pile guide 115 using more than two connectors 130. For example, in addition to the two connectors 130 associated with each pile 120 illustrated in FIG. 1, there can be another connector 130 located at approximately the midpoint of the pile guide 115.

Figure 2A:
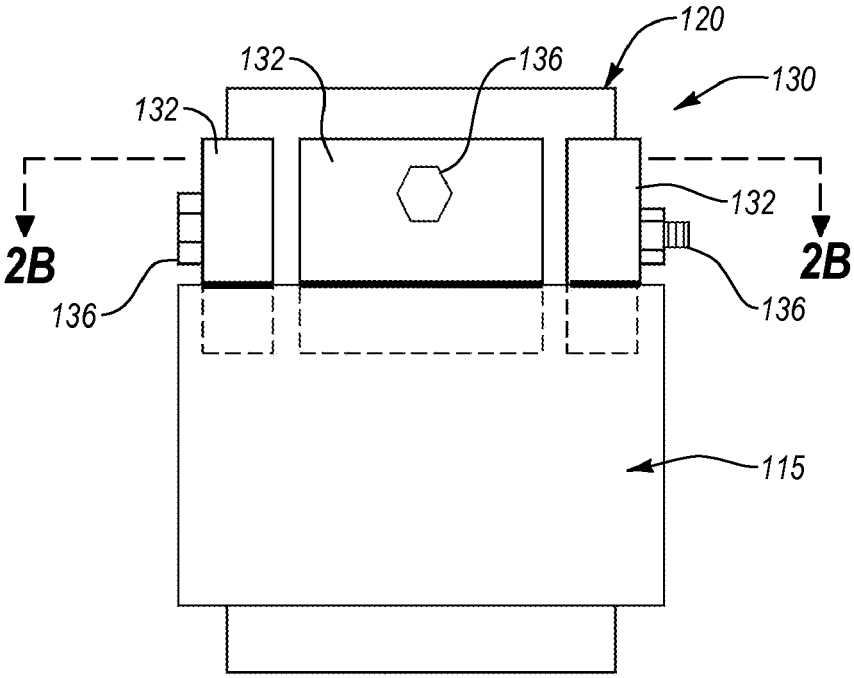
FIGS. 2A-2B illustrate example connectors used in conjunction with example implementations of the present invention.
Figure 2B:
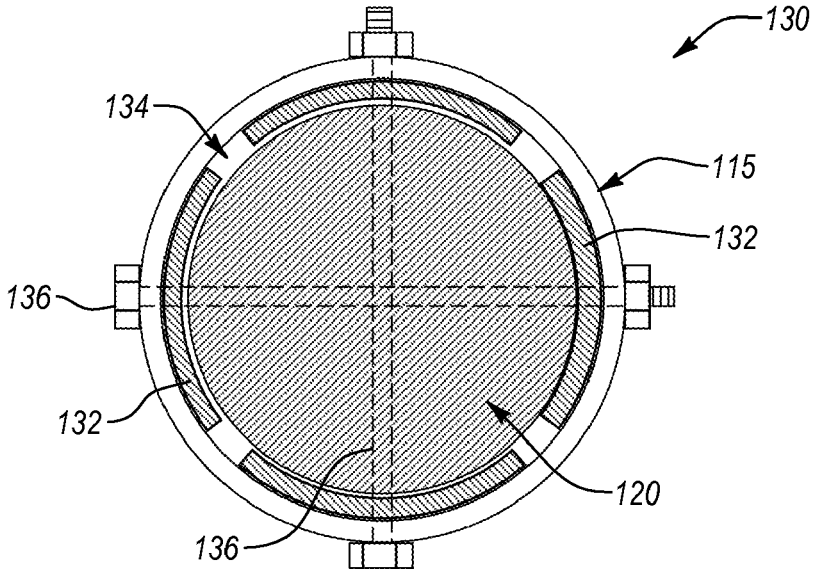

As mentioned above, the modular foundation 100 can include one or more connectors 130. FIGS. 2A-2B illustrate an elevation view and a cutaway view of an example connector 130 in accordance with one or more implementations of the present invention. In one implementation, an engineer can configure the connector 130 to connect a pile guide 115 to a driven pile 120. As a result, a contractor can utilize the connector 130 to secure the connection between driven piles 120 and a cap structure (i.e., 110, FIG. 1) within a modular foundation (i.e., 100, FIG. 1).

As discussed above in more detail, the pile 120 and pile guide 115 may have corresponding sizes and shapes. As shown in FIGS. 2A-2B, the example pile 120 can have a tubular configuration with a generally circular shape. In addition, the example pile 120 can have a generally circular configuration capable of being inserted through and/or disposed within the pile guide 115. In a further implementation, the pile guide 115 can have slightly larger interior dimensions than the exterior dimensions of the pile 120. As a result, a space or clearance 134 can exist between the pile guide 115 and an inserted pile 120. In one implementation, the connector 130 can include one or more structural elements configured to be positioned within the clearance 134 and configured to connect to the pile 120 and/or pile guide 115.

For example, in one implementation, the connector 130 can include one or more plates 132, such as shim plates, positioned between the pile 120 and pile guide 115 and at least partially within the clearance 134, as shown in FIGS. 2A-2B. The plates 132 can assist a contractor in securing and/or stabilizing the connection between the pile 120 and pile guide 115. In particular, an engineer can configure the plates 132 to substantially fill the clearance 132 to remove any "play" between the pile 120 and pile guide 115. For example, an engineer can configure the plates 132 to have sizes and shapes similar to the size and shape of the clearance 134. In one implementation, the plates 132 can have a generally arcuate shape configured to extend around a portion of the circumference of the pile 120 within the clearance 134. In another implementation, the plates 132 can have a generally flat configuration to correspond to a flat surface in either the pile 120 or pile guide 115.

The amount of clearance 134 filled by the plates 132 can vary as desired for a particular application. As shown in FIG. 2B, the plates 132 of the illustrated implementation each extend along almost one fourth of the circumference of the pile 120 and clearance 134. In further implementations, each plate 132 can extend along a greater or lesser portion of the circumference of the pile 120. For example, in one such implementation, each plate 132 can extend along up to about half of the circumference of the pile 120. In another implementation, each plate 132 can extend as little as one or more radial degrees about the circumference of the pile 120.

In addition to the size and shape of each plate varying, the number of plates 132 in a connector 130 can also vary as desired for a particular application. As shown in FIGS. 2A-2B, in one implementation, the connector 130 can include four plates 132. In further implementations, the connector 130 can include more or fewer plates 132. For example, the connector 130 can include five, six, seven, eight, nine, ten, eleven, twelve, or more plates 132. In another implementation, the connector 130 can include between one and three plates 132.

The thickness of each plate 132 can also vary as desired for a particular application. For example, in one implementation, the thickness of each plate 132 can be substantially continuous throughout the entire plate 132. In further implementations, the plate 132 can have a tapered thickness. For example, each plate 132 can have a thin end configured to facilitate insertion of the plate 132 into the clearance 134. In addition, the plate 132 can have a continuously increasing thickness along its length to more securely engage the pile guide 115 and pile 120 as the plate 132 advances into the clearance 134.

In addition to the thickness of the plate 132 varying, the materials used for the plates 132 can also vary as desired for a particular application. In one implementation, the plates 132 can include one or more structural steels. In further implementations, the plates 132 can include wood, high-strength polymers, other metals, composites, similar materials, or combinations thereof.

An assembler can connect the components of the connector 130 to the pile 120 and/or pile guide 115 in any of a number of different ways. For example, in one implementation, an assembler can weld the plates 132 to the pile 120 and/or pile guide 115. In particular, the assembler can weld along any seam between the plates 132, pile 120, and pile guide 115. In further implementations, the assembler can use epoxies, grout, bolts, other fastening mechanisms, or combinations thereof to connect the components of the connector 130 to the pile 120 and pile guide 115.

For example, as shown in FIGS. 2A-2B, the connector 130 can include one or more bolts 136 configured to connect the connector 130 to the pile 120 and/or pile guide 115. A bolt 136, as illustrated in FIG. 2A, can pass through a plate 132 positioned on a first side of the pile 120, through the pile 120, and through a plate 132 positioned on a second side of the pile 120, with a nut fastened on the other end of the bolt 136. In further implementations, each bolt 136 can pass through the plates 132, the pile 120, and the pile guide 115. In another implementation, each bolt 136 can pass only partially through the pile 120, such as into a first side of the pile 120, but not extending through both sides of the pile 120. In addition, the number of bolts 136 can vary. For example, although FIGS. 2A-2B illustrate the connector 130 including two bolts 136, in further implementations, the connector can include a lesser number of bolts 136, such as one, or a greater number of bolts 136, such as three, four, five, or more bolts 136.

In further implementations, the engineer can configure the connector 130 to leave one or more gaps in the clearance 134 between the plates 132. The engineer can also make the gaps between the plates 132 as small or as large as desired. For example, in one implementation, the engineer can configure the gaps to be practically nonexistent, with the plates 132 abutting each other. In another implementation, the engineer can configure the gaps between the plates 132 to be larger, such as shown in FIG. 2B, or even such that a majority of the clearance 134 is left open. In further implementations, an assembler can fill any remaining gaps in the clearance 134 with any desired material. For example, the assembler can fill the remaining gaps in the clearance 134 with welds, epoxies, grout, other similar materials, or combinations thereof.

In addition to the structure and design discussed above, implementations of the current invention can include a method of constructing a modular foundation 100. The method of constructing the modular foundation 100 of the present invention can include various steps. For example, the method can include prefabricating offsite one or more components to be included in the modular foundation 100. In particular, the cap structure 110 can be manufactured offsite and then delivered to the foundation site to be erected. Similarly, the piles 120 can be manufactured offsite and then transported to the construction site to be driven into the ground.

Figure 3A:
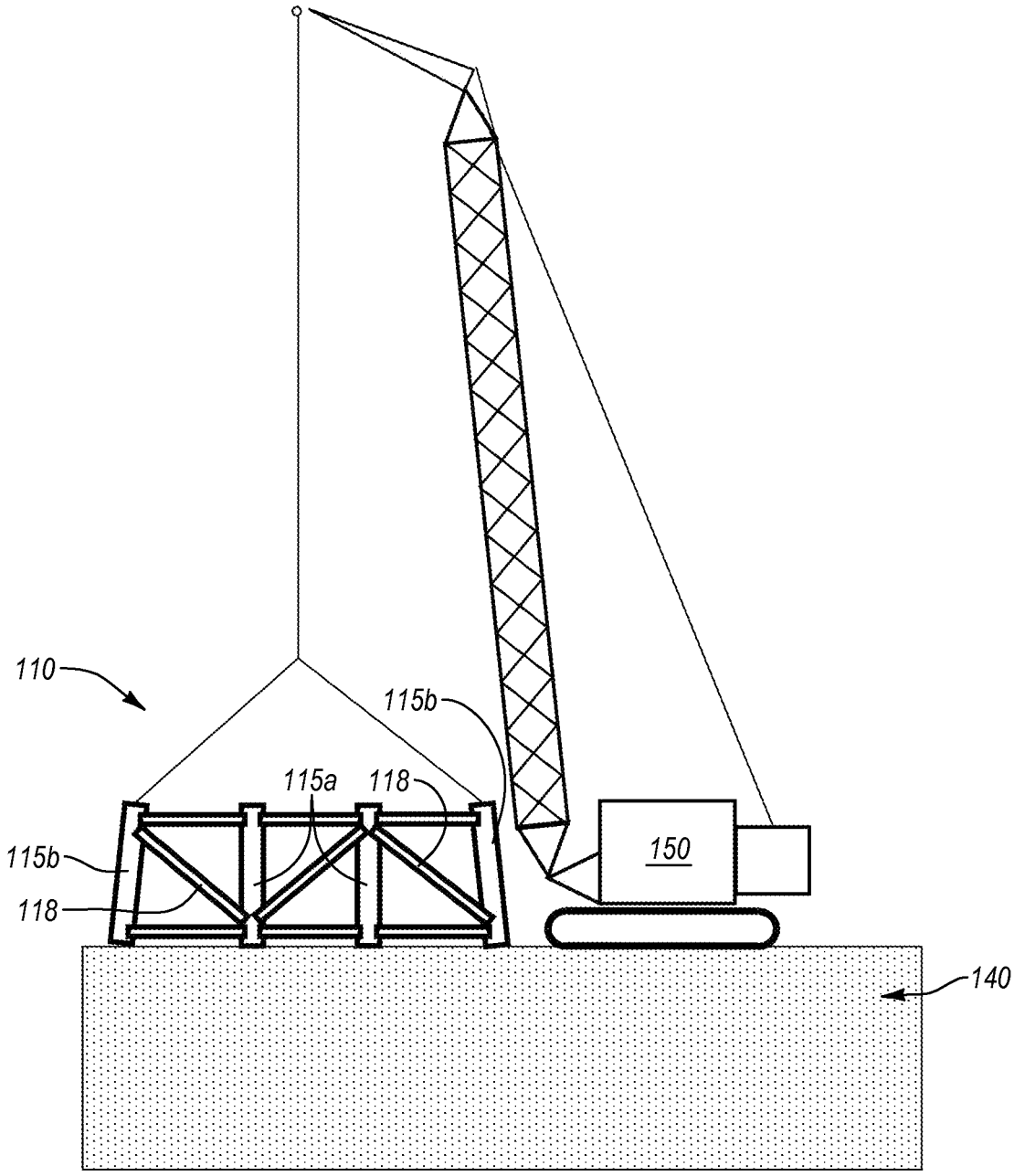
FIGS. 3A-3E illustrate sequential schematics of an example method for constructing a modular foundation in accordance with an implementation of the present invention.

Once the components of the modular foundation 100 are fabricated and delivered to the construction site. The method of construction can include a step of positioning the cap structure 110, as illustrated in FIG. 3A. For example, an assembler can use a crane 150 to lift, position, and place the cap structure 110 in a designated position with respect to the ground. Depending on the size of the cap structure 110, other equipment can be used to move and position the cap structure 110. In one implementation, the step of positioning the cap structure can include using surveying techniques and/or GPS devices.

Figure 3B:
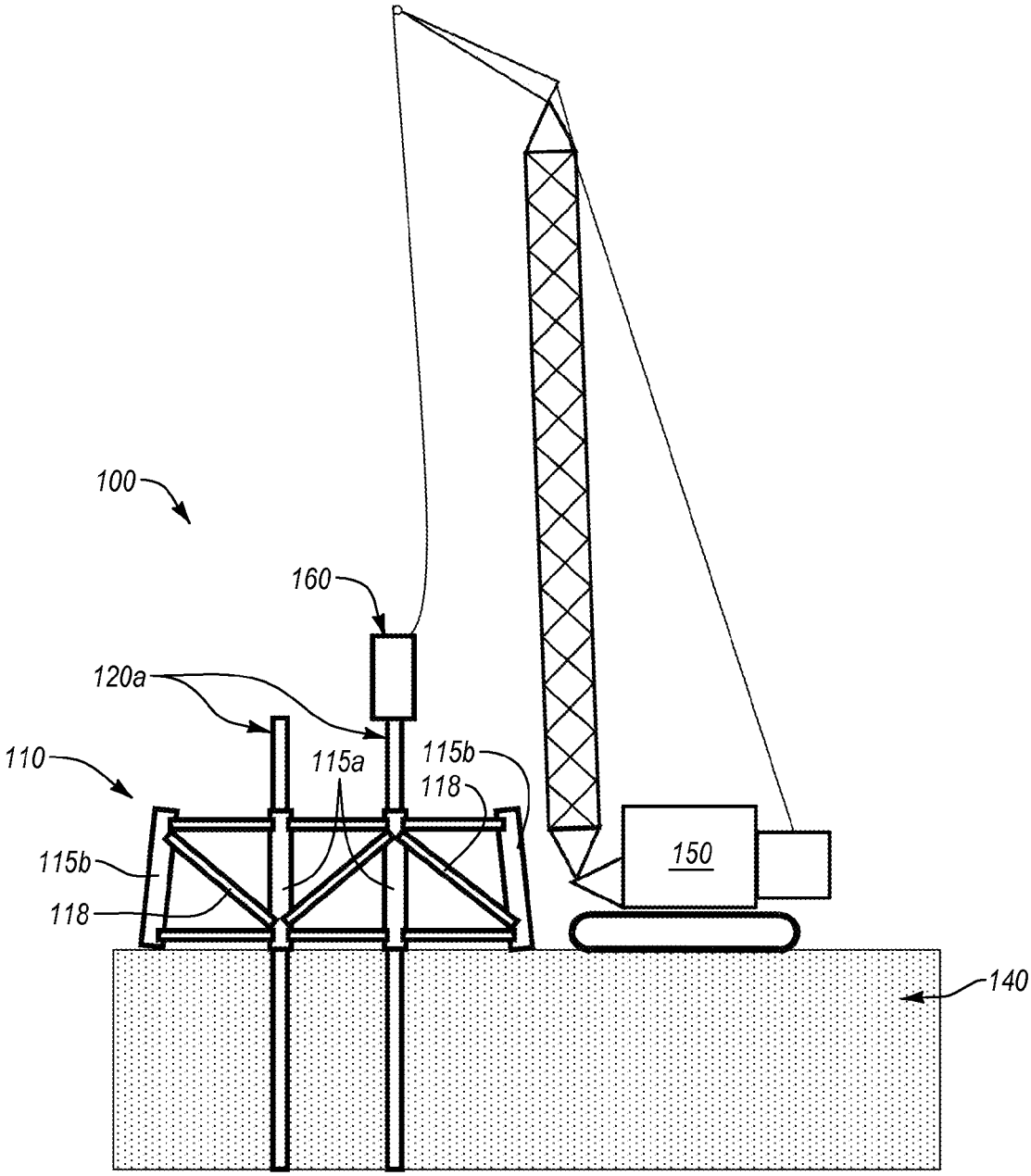

FIG. 3B illustrates a subsequent step in the method of constructing the example modular foundation 100. In particular, FIG. 3B illustrates an example step of driving vertical piles 120*a* trough the vertical pile guides 115*a* of the cap structure 110 and into the soil 140. The cap structure 110 can provide a template for driving the vertical piles 120*a* to facilitate precise placement and alignment of the vertical piles 120*a*. The cap structure 110 can also resist independent movement of the vertical piles 120*a* with respect to each other.

The vertical piles 120*a* can be of any desired length, and thus can be driven to a desired depth in the soil 140. The vertical piles 120*a* can also extend upwards through the vertical pile guides 120*a* and beyond the cap structure 110, as illustrated in FIG. 3B. A pile hammer 160, or other similar devices, can be used to drive the vertical piles 120*a* into the soil 140. As illustrated in FIG. 3B, the pile hammer 160 is associated with the crane 150 such that the crane 150 can drop the pile hammer 160 downward with sufficient force to drive the vertical piles 120*a* into the soil 140.

Figure 3C:
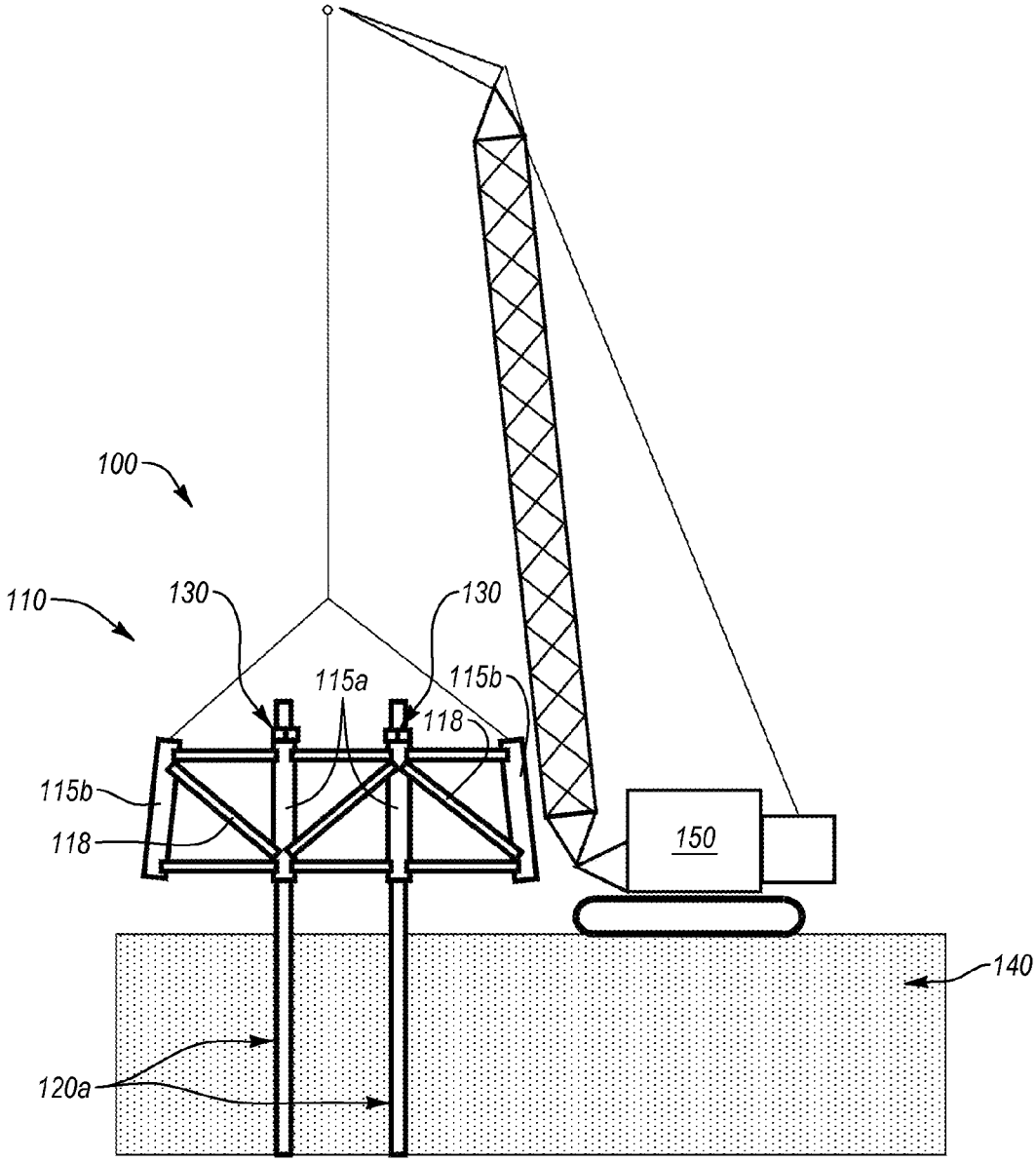

FIG. 3C illustrates an additional example step in constructing the modular foundation. Specifically, FIG. 3C illustrates an example step of positioning the cap structure 110 vertically to a desired height and then connecting the cap structure 110 to the driven vertical piles 120*a* with connectors 130. One or more connectors 130 can be used to facilitate the connection between the suspended cap structure 110 and the driven vertical piles 120*a*.

During the positioning of the cap structure 110, the assembler can use structural fill to support or further position the cap structure 110 in a desired position. For example, the structural fill can be similar to structural fill used for concrete structures. In particular, in one implementation, the structural fill can include compacted materials such as sand and/or gravel.

Figure 3D:
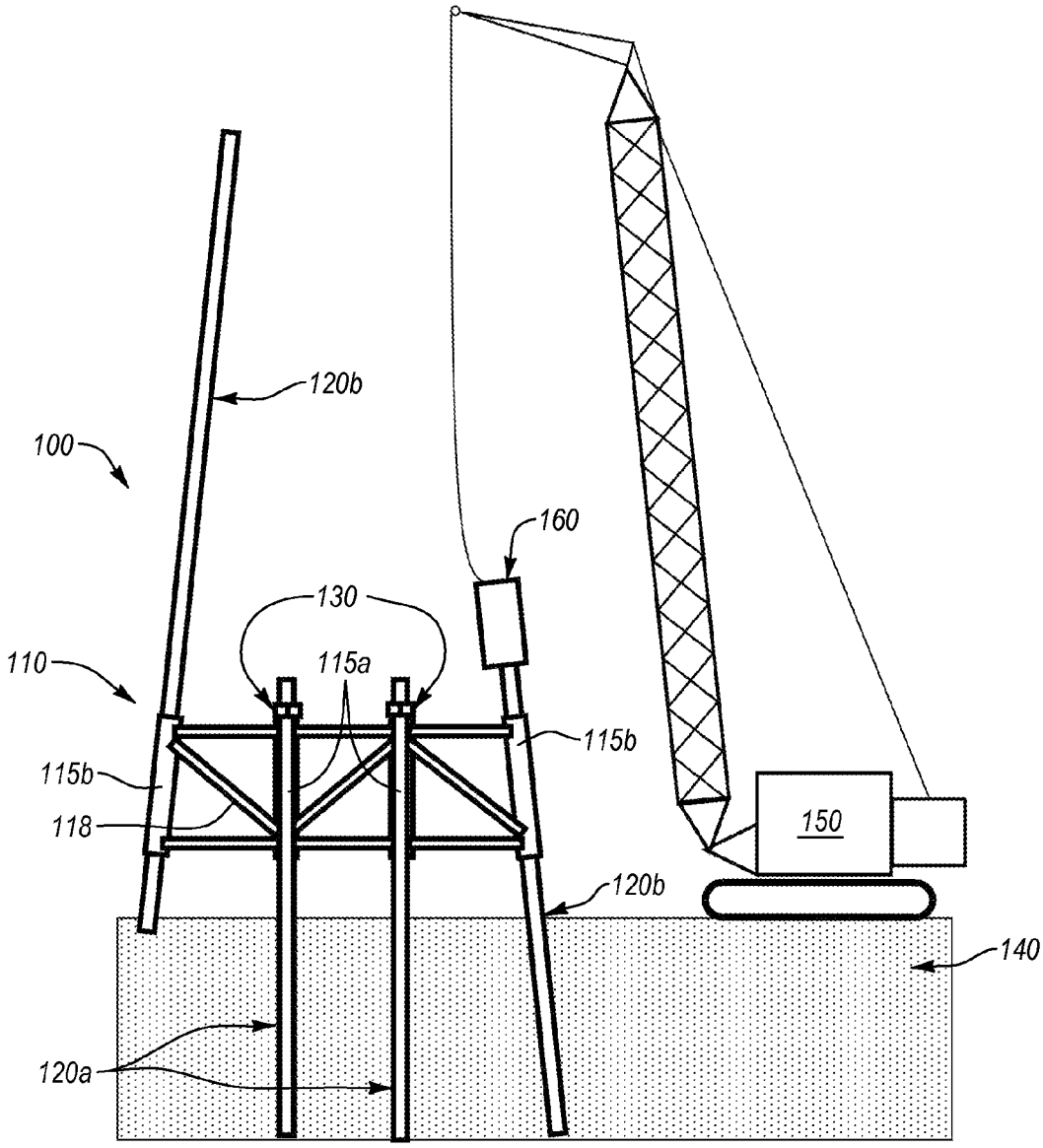
Figure 3E:
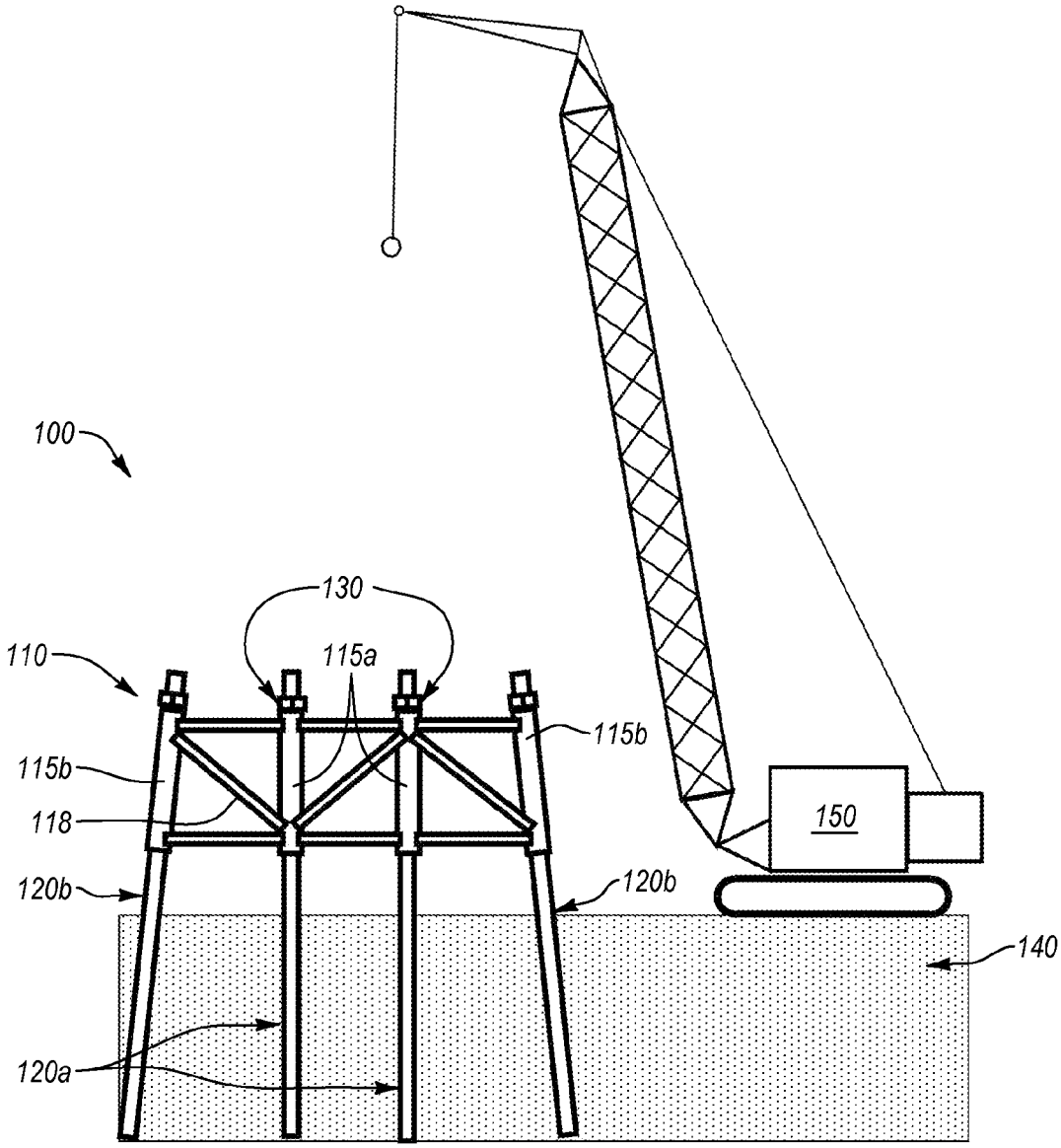

After connecting the cap structure 110 to the vertical piles 120*a*, the assembler can continue with addition example steps in the construction of the modular foundation 100. For example, FIG. 3D illustrates an addition example step of driving one or more angled piles 120*b* through the angled pile guides 115*b* of the cap structure 110 and into the soil 140. As shown, the angled pile guides 115*b* can guide the angled piles 120*b* along an angled orientation.

Due to the prefabricated nature of the angled pile guides 115*b*, the angled piles 120*b* can be assembled and driven into the soil 140 with a high degree of accuracy because the vertical piles 120*a* have already been driven into the soil 140. Thus, the cap structure 110 is a relatively rigid structure that allows the assembler to drive the angled piles 120*b* within tighter tolerances compared to tradition methods. Moreover, angled piles 120*b* resist lateral loads more efficiently than vertical piles 120*a* alone. Thus, the method of constructing the modular foundation allows engineers the ability to take advantage of angled piles 120*b* without sacrificing tolerances.

Once the angled piles 120*b* are driven to a desired depth, for example, the assembler can proceed with the construction of the modular foundation 100. FIG. 2E illustrates an additional example step of connecting the angled piles 120*b* to the cap structure 110. As a result, the cap structure 110 can act as a pile cap, grouping the piles 120 together and distributing loads among the multiple piles 120. In one example implementation, the assembler can also cut the ends off the piles 120 to a desired length above the cap structure 110, thus providing an accurate final height for the modular foundation 100.

Accordingly, FIGS. 3A-3E and the corresponding text disclose a method and system of constructing a modular foundation 100. This method can be repeated to form subsequent and/or preceding foundation sections along the length of a structure. The number of foundation sections used and the spacing of the foundation sections can be increased or decreased as desired for particular configurations.

Figure 4:
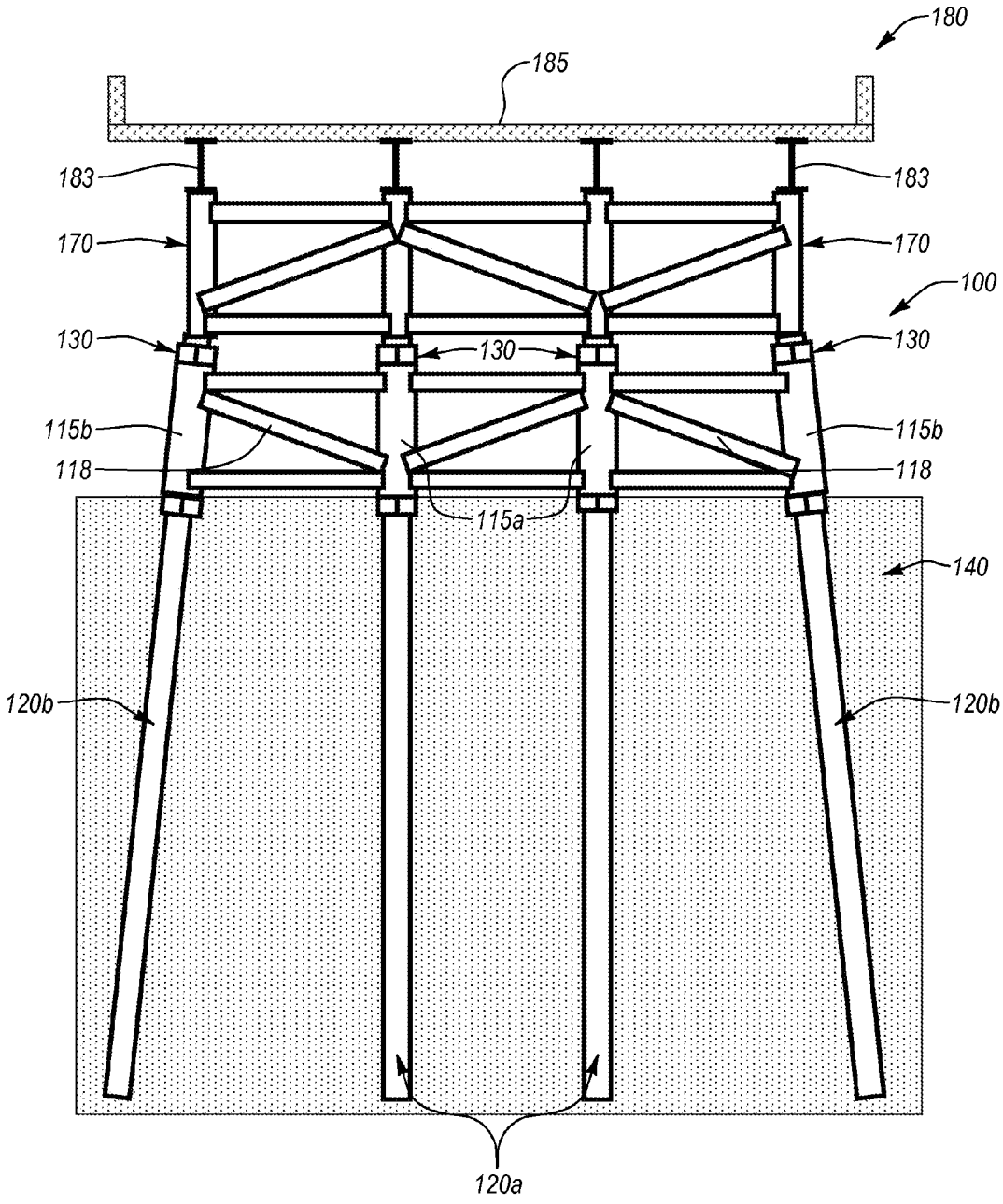
FIG. 4 illustrates an example superstructure that can be incorporated with an example modular foundation in accordance with an implementation of the present invention.

Referring now to FIG. 4, additional structural components that can be combined with the modular foundation 100 are illustrated. For example, FIG. 4 illustrates that an engineer can design a substructure 170 to connect to the modular foundation 100. As with the modular foundation 100, the substructure 170 can be prefabricated such that the substructure 170 can simply be dropped into place and connected to the modular foundation 100. In one implementation, the substructure 170 can be connected directly to the piles 120 such that the loads are directly distributed to the piles 120. Because the design of the modular foundation provides a cap structure 110 with precise tolerances, the substructure 170 can be fabricated well in advance of the placing of the modular foundation 100.

In addition to the substructure 170, an engineer can further support a super structure 180 using a modular foundation 100. The superstructure 180 can include one or more elements such as spanning elements 183. The spanning elements 183 can be coupled to or otherwise connected to the substructure 170 and can span between adjacent modular foundations 100, for example, such that the spanning elements are in a position to adequately support decking 185. As with the substructure 170, the spanning elements 183 and the decking 185 can be prefabricated. Therefore, the entire superstructure 180 can be made from a modular process, which decreases the amount of time to construct the superstructure 180, as well and decrease the cost of constructing the superstructure 180.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular foundation comprising:

a solid block concrete cap structure for positioning a plurality of piles, the solid block concrete cap structure including a plurality of pile guides having one or more vertical pile guides and one or more angled pile guides;

a plurality of piles, wherein:

each pile of the plurality of piles is configured to be guided by and to pass through the plurality of pile guides of the solid block concrete cap structure at either angled or vertical orientation; and each pile of the plurality of piles is configured to be driven into a soil or other material to secure the solid block concrete cap structure thereto; and one or more connectors configured to connect the solid block concrete cap structure to the one or more piles.

2. The modular foundation of claim 1, wherein the plurality of pile guides have shapes that correspond to shapes of the plurality of piles.

3. The modular foundation of claim 2, wherein the plurality of pile guides have interior dimensions that are slightly larger than the exterior dimensions of the plurality of piles.

4. The modular foundation of claim 3, wherein one or more pile guides of the plurality of pile guides have a generally tubular configuration.

5. The modular foundation of claim 1, wherein one or more pile guides of the plurality of pile guides have a generally circular or rectangular cross-sectional shape.

6. The modular foundation of claim 1, wherein the one or more piles of the plurality of piles are chosen from the group consisting tubular steel piles, concrete piles, reinforced concrete piles, H-piles, I-piles, and timber piles.

7. The modular foundation of claim 1, wherein at least one connector of the one or more connectors comprise a plurality of plates configured to be inserted between each pile of the plurality of piles and a corresponding pile guide and to center the pile to the corresponding pile guide.

8. The modular foundation of claim 7, wherein the at least one connector of the one or more connectors further comprises one or more bolts.

9. The modular foundation of claim 7, wherein the at least one connector of the one or more connectors further comprises one or more fastening materials chosen from the group consisting of epoxies, grouts, and welds.

10. The modular foundation of claim 1, wherein the pile guides comprise tubular steel.

11. A method of constructing a modular foundation, the method comprising:

positioning a cap structure at a desired position, wherein the cap structure comprises a plurality of pile guides;

driving one or more piles of a first set of piles at least partially through a first set of pile guides of the plurality of pile guides of the cap structure and into a material below the cap structure;

repositioning the cap structure along a length of the one or more piles of the first set of plies;

driving one or more piles of a second set of piles through a second set of pile guides of the plurality of pile guides of the cap structure; and connecting the cap structure to the one or more driven piles using one or more connectors.

12. The method of claim 11, further comprising positioning a superstructure on top of the one or more of the one or more piles of the first set of piles and of the second set of piles and the cap structure.

13. The method of claim 11, wherein positioning the cap structure at a desired position comprises setting the cap structure on a soil.

14. The method of claim 13, wherein repositioning the cap structure along a length of the one or more piles comprises raising the cap structure.

15. The method of claim 11, wherein the first set of pile guides of the plurality of pile guides are vertical and the one or more piles of the first set of piles are driven in a vertical orientation.

16. The method of claim 11, further comprising connecting the cap structure to the one or more piles of the first set of piles after repositioning the cap structure along a length of the one or more piles of the first set of piles.

17. A modular foundation system comprising:

a modular foundation comprising:

a plurality of cap structures, wherein each structure of the plurality of cap structures includes one or more vertical pile guides and one or more angled bile guides;

one or more piles fitted through the one or more vertical pile guides of the cap structure and driven into a soil or other material; and one or more piles fitted through the one or more angled pile guides of the cap structure and driven into a soil or other material;

one or more connectors connecting the cap structure to the one or more piles fitted through the one or more vertical pile guides of the cap structure and to the one or more piles fitted through the one or more angled pile guides of the cap structure; and a superstructure supported by the modular foundation, wherein the superstructure is positioned above the modular foundation.

18. The modular foundation system of claim 17, wherein the superstructure comprises one or more components of a pedestrian walkway.

19. The modular foundation system of claim 17, wherein the superstructure comprises one or more components of a port structure.

20. The modular foundation system of claim 17, wherein the superstructure comprises one or more components of a residential or commercial building.

21. The modular foundation system of claim 17, wherein the superstructure comprises one or more components of a wind turbine.

22. The modular foundation system of claim 17, wherein the super structure comprises one or more components of a bridge.

23. The modular foundation system of claim 17, further comprising a substructure configured to be supported by the modular foundation and configured to support the superstructure.

24. The modular foundation system of claim 17, wherein the plurality of cap structures comprise solid concrete blocks.

* * * * *